US006254336B1

(12) United States Patent
Ahn

(10) Patent No.: US 6,254,336 B1
(45) Date of Patent: Jul. 3, 2001

(54) SIROCCO FAN HAVING AN INCLINED CUTOFF

(75) Inventor: Cheol-O Ahn, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/233,076

(22) Filed: Jan. 19, 1999

(30) Foreign Application Priority Data

Jan. 20, 1998 (KR) ..... 98-1512

(51) Int. Cl.[7] ..... F04D 29/66

(52) U.S. Cl. ..... 415/119; 415/204; 415/206; 415/207; 415/212.1

(58) Field of Search ..... 415/119, 204, 415/205, 206, 207, 212.1

(56) References Cited

U.S. PATENT DOCUMENTS 353,994 * 12/1886 Walker et al. ..... 415/119

3,687,360 * 8/1972 Prew et al. ..... 233/46

FOREIGN PATENT DOCUMENTS

1100399 * 4/1989 (JP) .

OTHER PUBLICATIONS

W. Neise, "Noise Reduction In Centrifugal Fans: A Literature Survey", Journal Sound and Vibration (1976), 45(3), 375–403.

* cited by examiner

*Primary Examiner*—Edward K. Look
*Assistant Examiner*—Ninh Nguyen

(57) ABSTRACT

A sirocco fan which reduces abnormal noise and improves air flow includes: a scroll 2 with an inlet wall 8 and a closed endwall 9, the inlet wall 8 having an inlet and the endwall 9 being opposed to the inlet wall 8; and an impeller 3 provided in the scroll 2, for suctioning and exhausting air, wherein a cutoff 7 of the sirocco fan 1 is inclined so as not to allow entire sections of a blade 10 of the impeller 3 to be simultaneously met entire sections of the cutoff 7 when the blade 10 of the impeller 3 passes through the cuttoff 7, thereby achieving stable air flow.

6 Claims, 5 Drawing Sheets

SIROCCO FAN HAVING AN INCLINED CUTOFF

BACKGROUND OF THE INVENTION

1. Field of the Invention

The present invention relates to a sirocco fan, and more particularly, to a cutoff which divides an inlet and outlet side of the sirocco fan.

2. Discussion of the Related Art

Generally, a sirocco fan is kind of blower which is used for air-conditioning and ventilating, and is used in an air-conditioner or fan-coil heater. Also, the sirocco fan is called a multi-blade fan because it has about 30 to 50 blades. In this respect, the sirocco fan is compared differently with the radial fan having blades smaller than those of the sirocco fan.

FIGS. 1 and 2 are perspective and side views illustrating a related art sirocco fan.

The related art sirocco fan will be described with reference to FIGS. 1 and 2.

The sirocco fan 1 includes a scroll 2 which acts as air passage, and an impeller 3 which is provided in the scroll 2 and used for inlet and outlet of the air by the driving force of a motor (not shown).

The impeller 3 includes a pair of rims 3*a* and a plurality of blades 10 which are parallel to the rims 3*a*.

The scroll 2 is divided into a circular main body 2*a* where the impeller 3 is located and a diffuser 20 connected with the main body 2*a*. And the main body 2*a* includes an inlet wall 8 having an inlet 4 and a closed endwall 9 which is opposed to the inlet wall 8. A front end of the diffuser 20 acts as an outlet 5.

Therefore, in the sirocco fan 1, the air is sucked from the inlet 4 at the inlet wall 8 of the scroll 2 and exhausted out through the outlet 5 of the diffuser 20.

A reference numeral 6 which is not described is a bell-mouth which is located at the inlet 4 and fitted into the scroll 2 to guide sucking air and at the same time to shield the impeller 3.

In addition, the starting point in the diffuser 20 of the scroll 2 is a cutoff 7. The cutoff 7 is the standard point of the expansion radius of the scroll 2 and the important part to divide the inlet and outlet side.

In other words, since the cutoff 7 is the starting point which changes dynamic pressure into static pressure, it acts as the starting point of air outlet and quick change of pressure periodically occurs therein.

As shown in FIG. 2*b*, in the related art sirocco fan 1, the cutoff 7 is parallel to the blade 10 of the impeller 3 or it is tapered at about 2° or less so as to easily separate the scroll 2 from the mold when producing the scroll 2.

Referring to FIGS. 2*a* and 2*b*, the operation of the related art sirocco fan will be described below.

Once the impeller 3 which is located in the scroll 2 is rotated by the driving force of the motor, suction power occurs by the rotation of the impeller 3, so that the air is sucked into the scroll 2 through the inlet 4 formed in the inlet wall 8 of the scroll 2. The sucked air is exhausted out of the scroll 2 through the outlet 5 formed in the scroll 2 while flowing inside the scroll 2 by the continuous rotation of the impeller 3.

However, the related art sirocco fan has the following problems.

First, since the cutoff 7 is parallel to the blade 10 of the impeller, abnormal noise occurs significantly due to the blade passing frequency (BPF). The reason is, when the blade 10 of the impeller 3 meets the cutoff 7 by the rotation of the impeller 3, the blade 10 is parallel to the cutoff 7 and at the same time the entire sections of the blade 10 meet the entire sections of the cuttoff 7 so that there occurs abnormal noise due to the BPF in the entire length direction of the blade.

Second, as shown in the FIG. 3, the speed of the incoming air does not decrease until it hits the endwall 9 of the sirocco fan 1. Therefore the incoming air retains the axial speed component until the time it passes through the blade 10 of the impeller 3. For this reason, the air that has hit the endwall 9 is re-circulated along the side of the scroll 2.

Also, since the scroll 2 cannot transfer the dynamic pressure into static pressure, the flow speed of the point close to the endwall 9 at the outlet 9 is comparatively fast and at the inlet wall 8 the flow speed is rather slow, thereby causing flow of the exhausting air to be irregular. Moreover, counterflow A may sometimes occur.

In summary, in the related art sirocco far, there is a problem that the air flow is poor due to abnormal noise.

SUMMARY OF THE INVENTION

Accordingly, the present invention is directed to a sirocco fan that substantially obviates one or more of the problems due to limitations and disadvantages of the related art.

An object of the present invention is to provide a sirocco fan which reduces abnormal noise due to the BPF.

Other object of the present invention is to a sirocco fan which increases air flow rate and enables stable air flow.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a sirocco fan according to the present invention includes: a scroll with an inlet wall and a closed endwall, the inlet wall having an inlet and the endwall being opposed to the inlet wall; and an impeller provided in the scroll, for suctioning and exhausting air, wherein a cutoff of the sirocco fan is inclined so as not to allow entire sections of the blade of the impeller to be simultaneously met entire sections of the cutoff when the blade of the impeller passes through the cutoff, thereby achieving stable air flow.

It is preferable that the cutoff is inclined towards the endwall from the inlet wall of the scroll and it may have a straight lined shape or a curved shape. Also, the cutoff has preferably an inclined angle in the range of 20° between 50°, more preferably in the range of 30° between 40°. Therefore, the sirocco fan of the present invention can reduce abnormal noise and also achieve high air flow rate and stability of air flow.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
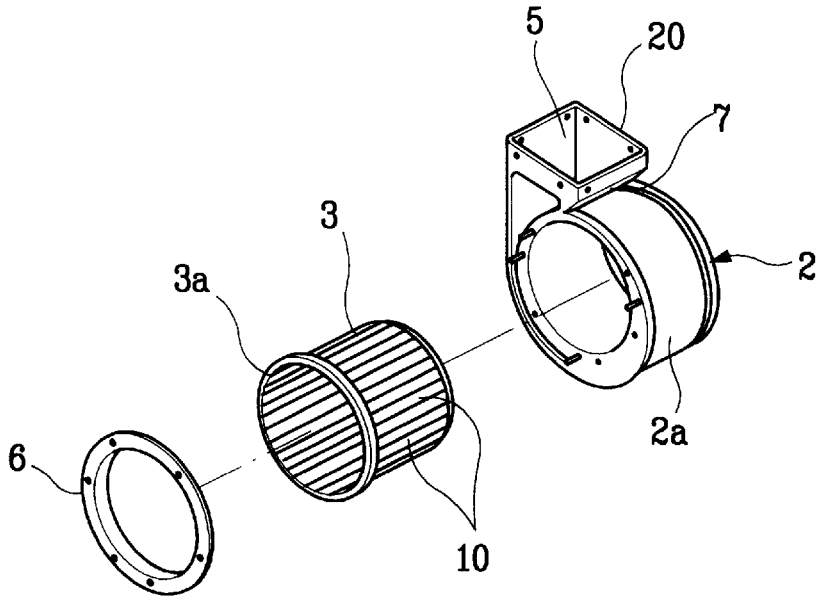
FIG.1 Background Art
FIG. 1 is an exploded perspective view illustrating a background art sirocco fan.
Figure 2A:
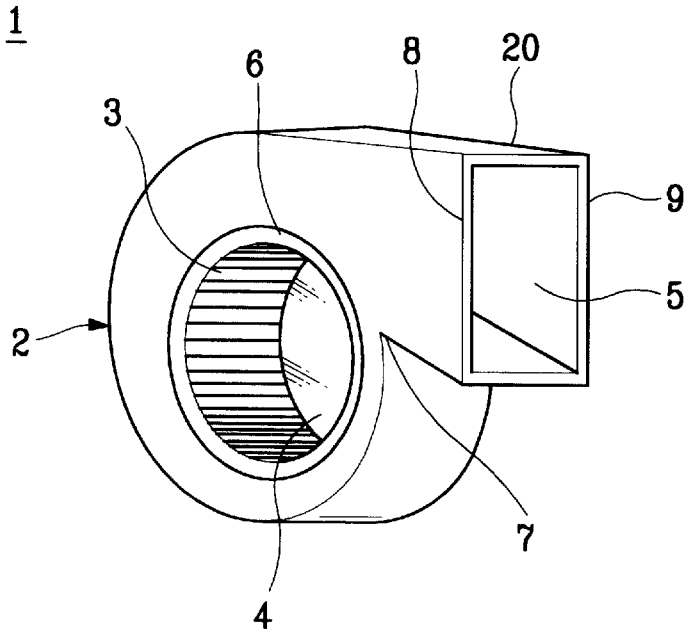
FIG.2A Background Art
FIG. 2*a* is a perspective view illustrating a background art sirocco fan.
Figure 2B:
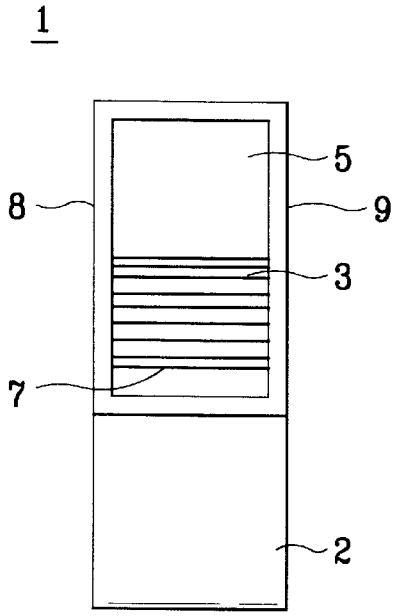
FIG.2B Background Art
FIG. 2*b* is a side view illustrating a background art sirocco fan in view of an outlet side.
Figure 3:
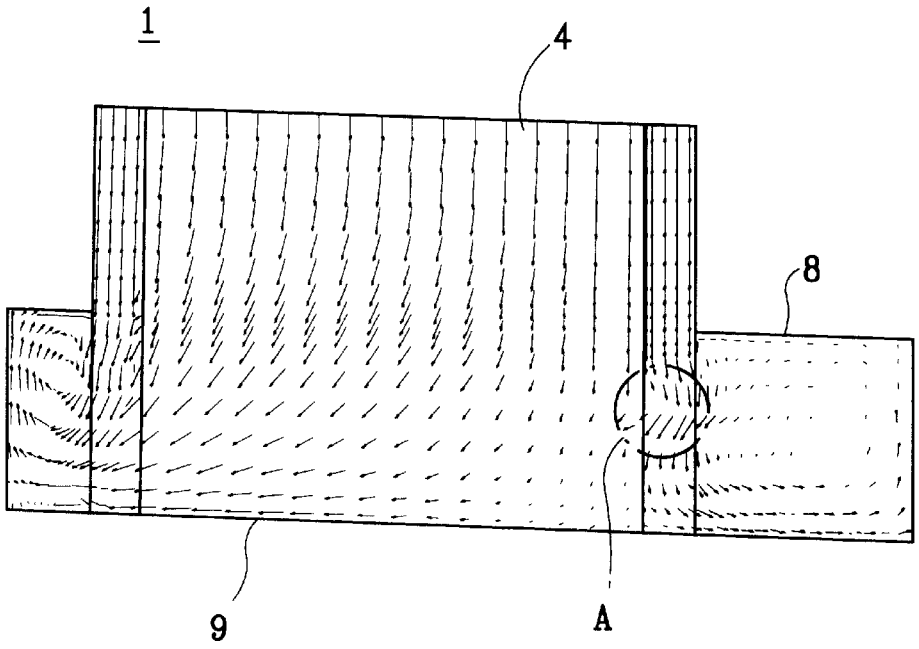
FIG.3 Background Art
FIG. 3 is a state view illustrating air flow in a background art sirocco fan.
Figure 4:
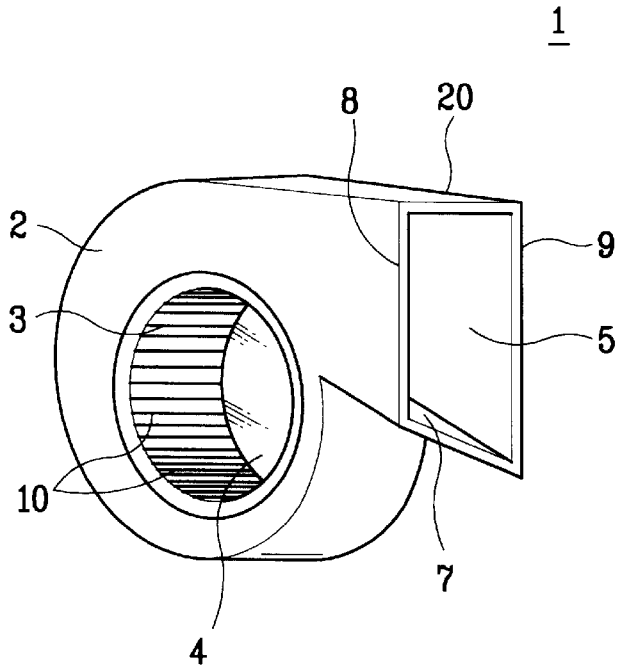
FIG. 4 is a perspective view illustrating a sirocco fan according to the first embodiment of the present invention.
Figure 5:
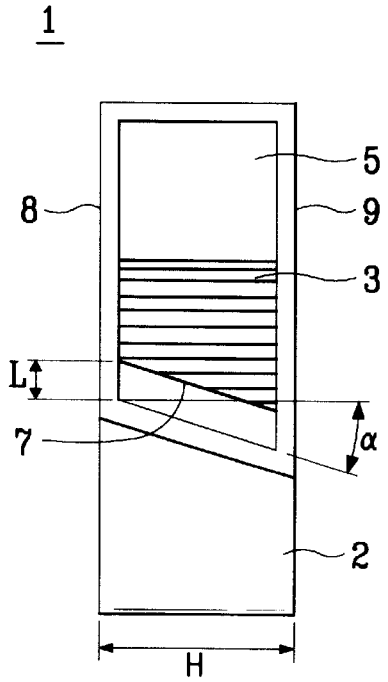
FIG. 5 is a side view of FIG. 4.

FIG. 4 is a perspective view illustrating the first embodiment of the present invention and FIG. 5 is a side view of FIG. 4.

A sirocco fan according to the present invention will be described with reference to FIGS 4 and 5.

The same terms and reference numerals are given to the same elements as those of the related art sirocco fan and their description is omitted.

In the same manner as the related art, the sirocco fan 1 of the present invention includes a scroll 2 and an impeller 3 located within the scroll 2. These scroll and impeller include the same elements as those of the related art.

The sirocco fan of the related art is different from that of the present invention in that the cutoff 7 of the related art sirocco fan 1 is parallel to the blade 10 of the impeller 3 while the cutoff 7 of the present invention crosses the blade 10 of the impeller 3 each other. In other words, the cutoff 7 is inclined with a predetermined angle towards the endwall 9 from the inlet wall 8. In this case, the blade 10 of the impeller 3 does not simultaneously meet the entire sections of the cutoff 7 but crosses the cutoff 7, when the blade 10 passes through the cutoff 7 by its rotation. Therefore, it is resulted in better air flow and noise reduction.

The cutoff 7 is preferably inclined to be down from the inlet wall 8 to the endwall 9.

Figure 6:
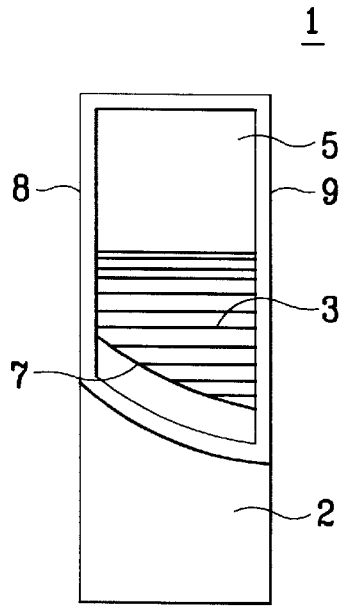
FIG. 6 is a side view illustrating a sirocco fan according to the second embodiment of the present invention.
Figure 7:
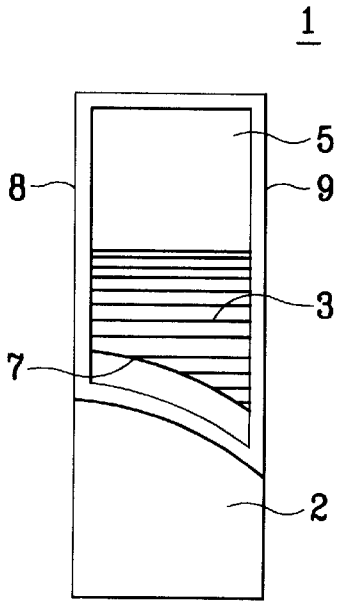
FIG. 7 is a side view illustrating a sirocco fan according to the third embodiment of the present invention.
Figure 8:
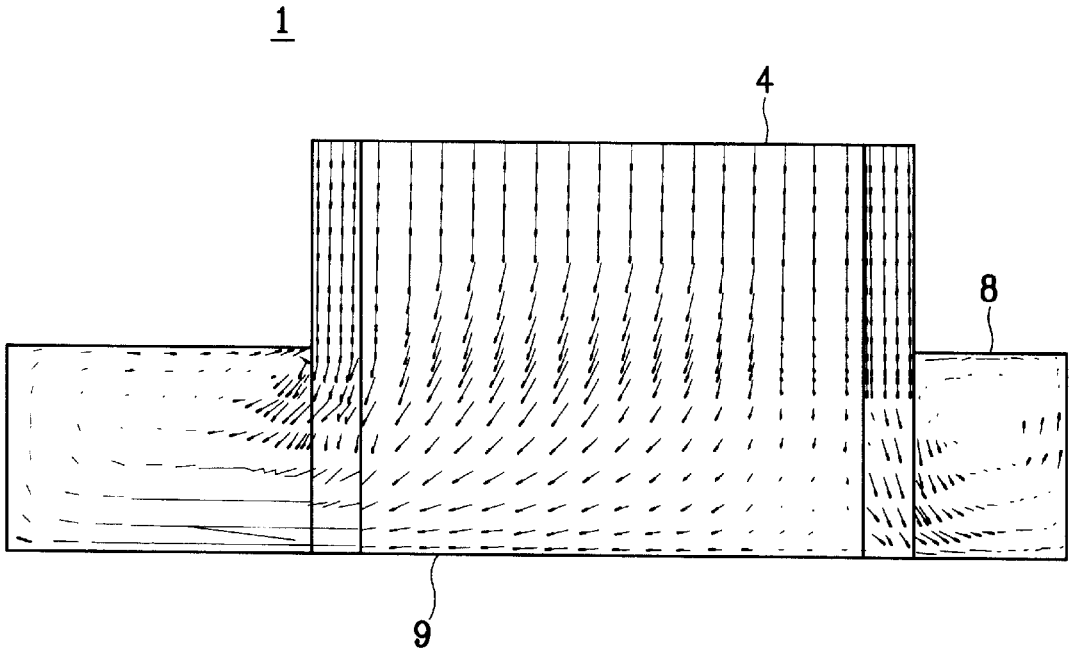
FIG. 8 is a state view illustrating air flow in a sirocco fan according to the present invention.

Meanwhile, as shown in the FIGS. 6 and 7, the cutoff 7 may be formed with a curved line having a predetermined curvature. The curved line of the cutoff 7 may be formed with a convex shape upwards or downwards.

The operation of the aforementioned sirocco fan according to the present invention will be described below.

The air sucked through the inlet 4 of the scroll 2 by rotation of the impeller 3 circulates inside the scroll 2 and then is exhausted out of the sirocco fan 1 through the outlet 5, i.e. the front end of the diffuser 20 in the scroll 2.

At this time, unlike the related art, in the present invention, the cutoff 7 formed in the outlet 5 of the scroll 2 is inclined with a predetermined angle, so that the air sucked into the sirocco fan 1 is smoothly exhausted out.

To explain in more detail, the blade 10 of the impeller 3 is inclined with a predetermined angle against the cutoff 7, so that the entire sections of the blade 10 do not meet the entire sections of the cutoff 7 at the same time. That is, since the blade 10 and the cutoff 7 cross each other, fluctuation of pressure generated when the blade 10 passes through the cutoff 7 could be reduced.

In view of any one of the blade, one side of the blade 10 starts to contact from inlet wall 8 and another side of the blade 10 starts to contact from the endwall 9 so that the blade 10 passes through the cutoff 7, thereby resulting in slowness in the pressure fluctuation due to interference between the blade 10 and the cutoff 7.

In other words, when the blade 10 and the cutoff 7 cross each other, there is a partial phase difference so that the pressure fluctuation naturally goes to the blade direction and the air flow goes on smooth.

Also, even the distance between the blade 10 and the cutoff 7 is getting closer, discrete frequency sound due to the BPF can effectively be restrained.

In accordance with the present invention, the cutoff 7 is downwards inclined to the endwall 9 so that it is resulted in the area of the endwall 9 is comparatively getting larger while the area in the inlet wall 8 is getting smaller. In other words, the outlet area of the sidewall 9, where the outlet speed is relatively is fast and the air flow is comparatively stable, is getting larger, on the contrary, the outlet area of the inlet wall 8 where the outlet speed is slow and apt to be unstable air flow is getting smaller. As a result, the entire air flow rate is getting increased and the air flow is getting stabilized.

Furthermore, as compared with the related art, the length of the scroll 2 where the real diffusing occurs is getting increased so that it is good for the recovery of the static pressure and the air flow is getting stable and the air flow rate is increased.

Meanwhile, it may be expected that the best preferred inclined angle $\alpha$ can be obtained provided the inclined angle of the cutoff 7 is defined as $\tan \alpha = H/L$ (where, H is the width of the scroll and L is the width of the cutoff.). If the inclined angle reaches a maximum value, i.e. 90°, there exists no incline. Therefore, the best preferred inclined angle $\alpha$ can be obtained between 0° and 90°.

Figure 9:
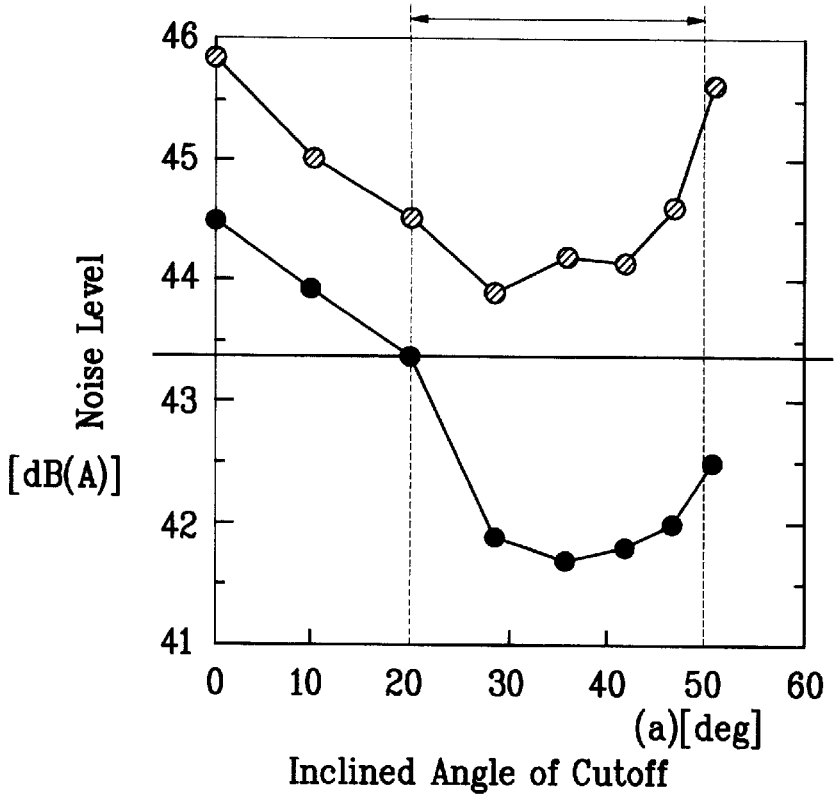
FIG. 9 is a graph illustrating noise to an inclined angle of a cutoff in a sirocco fan according to the present invention.

The measure of noise to variation of the inclined angle $\alpha$ of the cutoff 7 are shown in FIG. 9.

FIG. 9 shows test results of two sirocco fans with different curvatures of bell-mouth.

In FIG. 9, it can be identified that noise car be reduced when the cutoff 7 is inclined with a predetermined angle.

If the inclined angle $\alpha$ is 0°, that is, in the related art sirocco fan, noise is about 45.2 dB. On the other hand, if the inclined angle $\alpha$ is about 35°, the noise is about 41.2 dB.

It is noted that the noise can significantly be reduced when the inclined angle $\alpha$ is in the range of 20° between 50°. Particularly, it is noted that the noise can more efficiently be reduced when the inclined angle $\alpha$ is in the range of 30° between 40°.

The aforementioned sirocco fan according to the present invention can be used in a package type air-conditioner, a window type air-conditioner, a ceiling type or ceiling buried type air conditioner, and the like. Furthermore, the sirocco fan can be used for the purpose of radiating indoor fan coil unit or office machineries, or utensil instruments. The sirocco fan can alternatively be used in the commercial sirocco blower and the other sirocco fans/blowers.

As aforementioned, the sirocco fan according to the present invention has the following advantages.

First, since it is possible to reduce abnormal noise caused by the BPF which occurs when operating the sirocco fan, stable operation can be realized when the sirocco fan is used in the air-conditioner.

Further, it is possible to efficiently reduce abnormal noise due to the BPF even if the distance between the cutoff and the blade of the impeller becomes shorter. This increases free design of the sirocco fan.

Finally, since air flow rate of the sirocco fan can be increased and stable air flow can be achieved, performance of the sirocco fan can be improved.

It will be apparent to those skilled in the art that various modifications and variations can be made in the sirocco fan according to the present invention without departing from the spirit or scope of the invention. Thus, it is intended that the present invention covers the modifications and variations of the invention provided they come within the scope of the appended claims and their equivalents.

What is claimed is:

1. A sirocco fan comprising:

a scroll with an inlet wall and a closed endwall, the inlet wall having an inlet and the endwall being opposed to the inlet wall; and an impeller provided in the scroll, for suctioning and exhausting air, wherein a cutoff of the sirocco fan is inclined at an inclined angle in the range of between 30° and 40° so as not to allow entire sections of a blade of the impeller to be simultaneously met by entire sections of the cutoff when the blade of the impeller passes through the cutoff.

2. The sirocco fan as claimed in claim 1, wherein the cutoff is downwards inclined from the inlet wall of the scroll to the endwall.

3. The sirocco fan as claimed in claim 2, wherein the cutoff has a curved shape with a predetermined curvature.

4. The sirocco fan as claimed in claim 2, wherein the cutoff has a curved shape which is convex downwards.

5. The sirocco fan as claimed in claim 2, wherein the cutoff has a curved shape which is convex upwards.

6. The sirocco fam as claimed in claim 3, wherein an inclined angle between a straight line, which connects a start point of the cutoff with its end point, and a horizontal line is in the range of between 30° and 40°.

* * * * *